US006116340A

United States Patent [19]

Wilson et al.

[11] Patent Number: 6,116,340

[45] Date of Patent: Sep. 12, 2000

[54] DOWNHOLE BUILD-UP PRESSURE TEST USING COILED TUBING

[75] Inventors: Scott James Wilson, Plano; Keith Randall Ferguson, Allen; Medhat Mohamed Kamal, Plano, all of Tex.

[73] Assignee: Atlantic Richfield Company, Chicago, Ill.

[21] Appl. No.: 09/220,710

[22] Filed: Dec. 24, 1998

[51] Int. Cl.[7] ..... E21B 47/00

[52] U.S. Cl. ..... 166/250.17; 73/152.22; 73/152.36

[58] Field of Search ..... 166/250.17, 188, 166/250.08; 73/152.22, 152.36, 152.51

[56] References Cited

U.S. PATENT DOCUMENTS

| | | | |
|---|---|---|---|
| 4,519,456 | 5/1985 | Cochran | 166/312 |
| 4,962,815 | 10/1990 | Schultz et al. | 166/387 |
| 5,287,741 | 2/1994 | Schultz et al. | 73/155 |
| 5,350,018 | 9/1994 | Sorem et al. | 166/250 |
| 5,651,664 | 7/1997 | Hinds et al. | 417/172 |
| 5,803,186 | 9/1998 | Berger et al. | 175/50 |

OTHER PUBLICATIONS

"Permanent and retrievable pressure gauges" Flopetrol–Schlumber Catalog, 1982–83.

"Hydraulic Pump Systems–Jet Pump" Guiberson–Dresser Catalog, 1982–83.

"Downhole Sensor Package" DSP Dowell–Schlumber Brochure 1998.

*Primary Examiner*—Lanna Mai
*Assistant Examiner*—Elaine Gort
*Attorney, Agent, or Firm*—James A. Gabala; Robert E. Sloat

[57] ABSTRACT

A method and an apparatus for carrying out a downhole shut-in, pressure build-up test of a formation by lowering a string of coiled tubing having a pressure sensor and a packer thereon through the production tubing of the well. The packer is set to isolated the formation and the pressure is then measured by the pressure sensor. If the well is not flowing due to fluid standing in the wellbore, the well is first unloaded by flowing fluid down the coiled tubing to lift the fluid and reestablish flow into the well prior to setting the packer.

3 Claims, 3 Drawing Sheets

DOWNHOLE BUILD-UP PRESSURE TEST USING COILED TUBING

DESCRIPTION

1. Technical Field

The present invention relates to a method and apparatus for carrying out a downhole shut-in, pressure build-up test in a wellbore using a string of coiled tubing and in one aspect relates to a method and apparatus for carrying out a downhole pressure test wherein a coiled tubing string is lowered through the production tubing in a wellbore and is first used to lift the fluids in the well and is then closed to isolate the production formation thereby allowing the pressure in the reservoir opposite the wellbore at a location close to the point of influx to build-up which, in turn, is measured by a sensor carried by the coiled tubing. Also, by using coiled tubing to run the pressure test, a treating fluid (e.g. acid, solvent, bleach, etc.) can be flowed down the coiled tubing to stimulated flow from a particular formation before carrying out the pressure test.

2. Background

In the production of hydrocarbons from subterranean formations, it is standard procedure to test a production well from time to time to determine the then existing, downhole "build-up" pressure in the well adjacent a producing formation. These tests provide valuable data which is typically used in the engineering and maintaining of the well over its production life. For example, bottom-hole, shut-in pressures are typically used in calculating the rate at which the pressure in the producing formation is declining thereby providing valuable information in predicting the overall productive life of a well as well as how best to produce the well to achieve maximum recovery of hydrocarbons. This data also provides important characteristics of the well itself, including permeability and skin factor.

Several different techniques are known for measuring bottom shut-in pressures opposite a formation. For example, the well may be closed in at the surface after which the pressure in the production tubing is measured at the surface. The downhole pressure is then calculated by (a) adding the pressure equivalent to the fluid head in the tubing to (b) the measured pressure in the tubing at the surface. While the downhole pressure can be estimated in this way, the factors normally involved in such situations are often uncertain and vary to such an extent that the results may be misleading. The quality of the pressure data collected is degraded by the volume of fluid in the wellbore and the ability to predict the weight of this fluid.

Other known methods for measuring bottom-hole pressures involve attaching a pressure sensor to the outside of the production tubing before it is lowered in a wellbore so that the sensor will be positioned adjacent the producing formation when the tubing is in place. The sensor may either be of the self-contained type (i.e. those which record the pressure readings internally which are then retrieved when the tubing is withdrawn to the surface) or it may be of the type which produces a signal representative of the measured pressure which, in turn, is transmitted to the surface through a cable attached to the tubing. Still further, the sensor may be lowered down the well on a wireline or coiled tubing and recording the pressure adjacent the production formation.

When using any of these types of above-described, downhole sensors for determining the "build-up" pressures of a formation, the well is typically shut in at the surface even though the pressure measurements are being taken downhole adjacent the producing formation. Due to the large volume of flow conduit between the point of fluid influx and the point where the flow is shut-in at the surface, this again, may lead to results which are significantly different from the true shut-in, bottom-hole pressure responses of the formation, especially in deep wells, due to the large volume in the wellbore.

Further, in wells producing gas and oil, the large compressibly of the gas will cause the measured pressures at the surface to be substantially different from those pressures measured downhole adjacent an isolated formation. Another disadvantage of running pressure build-up tests without isolating the formation is that such tests must be run for long periods of time in order to obtain relevant information about the reservoir. This, in turn, adds substantially to the testing costs and increases the lost production from the well during the shut-in of the well.

In certain instances, communication of the formation with an unblocked wellbore will result in some of the important features of the pressure response being masked, thereby preventing a valid analysis of the test data. Therefore, it is desirable to isolate the formation from the rest of the wellbore during the pressure build-up test.

Also, additional problems are normally present when carrying downhole, build-up pressure tests for formations where the formation pressure has significantly declined. That is, if the formation pressure has declined to a point where a slight head of fluid in the wellbore will prevent flow of fluids from the formation into the wellbore, it will be necessary to "unload" or lift the head of well fluids in the wellbore to reestablish flow into the wellbore before a meaningful build-up pressure test can be carried out. Also, an effect known as "wellbore storage" can cause the reservoir's pressure build-up to be distorted or masked. Eliminating this storage volume by shutting-in the well closer to the formation provides a more direct measurement of the pressure behavior of the reservoir.

SUMMARY OF THE INVENTION

The present invention provides a method and an apparatus for carrying out a bottom hole, shut-in, pressure build-up test of a producing formation within a well by lowering a string of coiled tubing having a pressure sensor and a packer thereon through the production tubing of the well. The coiled tubing is lowered to a point substantially adjacent the formation and the formation is isolated by setting the packer above the formation. The pressure sensing means then measures the pressure within the well as it builds up therein.

Preferably, the packer on the coiled tubing is an inflatable packer which is set by pumping a ball down the coiled tubing and into sealing engagement with a seat within the coiled tubing to thereby block further downward flow through said coiled tubing. Fluid is diverted out through openings in the coiled tubing adjacent the packer to inflate the packer. In wells where the formation pressure is insufficient to permit flow into the well after a head of fluid has accumulated in the wellbore, the well is first unloaded by pumping fluid, e.g. gas, down the coiled tubing before the packer is set to force the standing head of fluid to the surface (by gas lift, jet pump, or the like) through the production tubing and to reestablish flow from the formation before the test is carried out. Once the test is completed, the packer is released and the coiled tubing is withdrawn from the production tubing. Also, in those instances where the formation is damaged and/or the formation fluids do not readily flow from the formation, the formation can first be treated by pumping a treating fluid (e.g. acid, solvent, bleach, etc.)

down the coiled tubing to stimulate flow from the formation before carrying out the pressure test.

More specifically, in carrying out the present method, a string of coiled tubing is run down the production tubing to a point substantially adjacent the production zone. The coiled tubing carries an inflatable packer which will be in its retracted or deflated position when the coiled tubing is run into or is withdrawn from the production tubing. Coiled tubing has a means (e.g. a plurality of openings through the wall thereof) for inflating the packer and a seat therein which is positioned slightly below the lower end of packer. Artificial lift means (e.g. ports for use in gas lifting the well, a jet pump, or the like) are provided near the lower end of the coiled tubing and a pressure sensing device is carried at the lower extremity of the coiled tubing.

In carrying out the pressure build-up test, the coiled tubing with the packer, lift device, and pressure sensing device is lowered down production tubing to a point substantially adjacent producing formation. If there is a standing head of fluid in the wellbore, the lifting device is actuated by flowing a fluid under pressure down the coiled tubing to unload the well and reestablish flow from formation into the wellbore. Once the head of standing fluids has been unloaded, formation fluids can again flow into the wellbore. After a period of steady flow sufficient to provide a meaningful pressure build-up within the wellbore, a ball is pumped down the coiled tubing string until it contacts the seat in the coiled tubing. Fluid will now flow through the openings adjacent the packer to inflate the packer and effectively isolate the formation from the rest of the wellbore. If the formation has been damaged and/or the formation fluids do not readily flow into the wellbore, a treating fluid can be pumped down the coiled tubing to stimulate flow from the formation.

The fluids will now flow from the formation into the wellbore below the now-sealed, bottom section of the coiled tubing thereby causing the bottom hole pressure in the wellbore to build-up and be measured by the pressure sensing device on end of the coiled tubing. Upon completion of the build-up pressure test, the pressure within the coiled tubing is relaxed to thereby deflate the packer on the coiled tubing. The string of coiled tubing can now be moved to test another section of the formation or it can be easily withdrawn to the surface after which the well can be returned to production.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
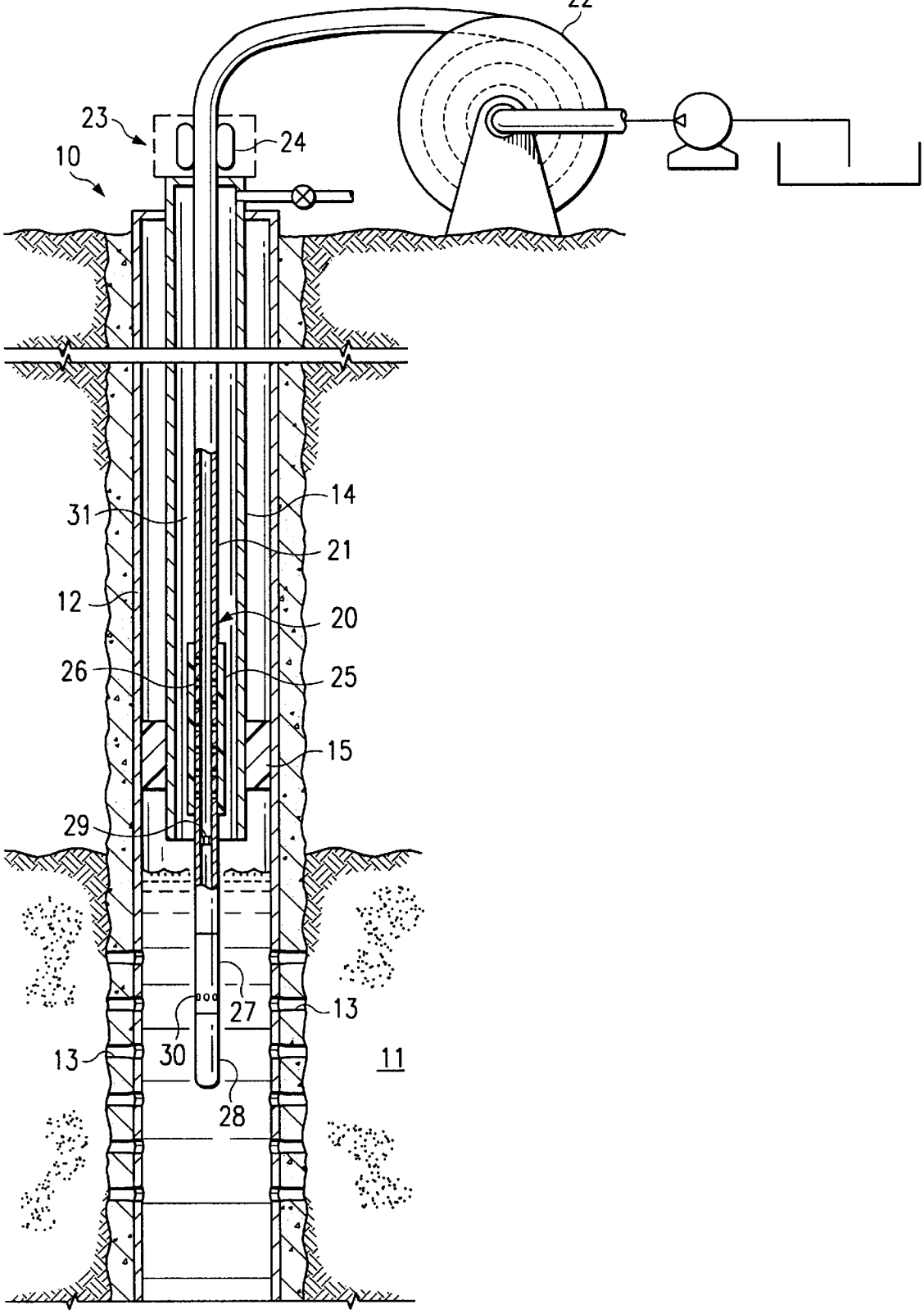
FIG. 1 is an elevational view, partly in section, of the apparatus for measuring the downhole pressure of a well in accordance with the present invention wherein the packer of said apparatus is in a retracted position.

Referring now more particularly to the drawings, FIG. 1 illustrates the present apparatus 20 for carrying out a bottom-hole, build-up pressure test for producing formation or zone 11 in well 10. Well 10, as shown, has been cased along its length with casing 12 which, in turn, has been perforated to form perforations 13 adjacent formation 11. While the present invention is shown and described in relation to testing a formation or zone in a cased, vertical wellbore, it should be understood that the invention can also be used for carrying out pressure tests in open holes as well as in horizontal or deviated wellbores.

A string of production tubing 14 extends down through casing 13 from the surface to a point substantially adjacent production zone 11 and carries a packer 15 which isolates zone 11 from the casing annulus above the packer. Under normal production conditions, fluids from zone 11 will flow through perforations 13 and into the wellbore and are produced to the surface through production tubing 14. In some wells, the pressure within zone 11 is sufficient to force the fluids all the way to the surface. In other wells where the pressure is insufficient to lift the fluids to the surface, it is well known to use artificial lift means (e.g. gas lift, downhole pump, etc. not shown) to lift the fluids through production tubing 13 to the surface.

As will be understood in the art, it is desirable to test producing formation 11 from time to time during its operational life to determine the downhole, pressure build-up of the formation. Where the formation pressure of formation 11 is less than that required to lift a complete head of fluid (e.g. around 0.45 psi/ft), carrying out such a test is complicated since the formation fluids will cease to flow from formation 11 into the wellbore once a relatively small head of fluid has built up in the wellbore. Accordingly, the well will normally have to be "unloaded" before commencing the pressure build-up test, i.e. the head of fluid in the wellbore will need to be lifted to the surface and flow from the formation reestablished into the wellbore before pressure testing is commenced.

In accordance with the present invention, a string of coiled tubing 21 is run down production tubing to a point substantially adjacent production formation 11. As used in the art, the term "coiled-tubing" refers to a long, continuous length of a relatively small-diameter, steel tubing 21 which is wound off and onto a large-diameter reel 22 which, in turn, is usually mounted on a trailer (not shown) or the like so that it can be moved from site to site when needed. Coiled tubing 21 is paid out from reel 22 and through an injector unit 23 into wellbore 10. Injector unit 23 is positioned above the wellhead of wellbore 10 and typically includes a pair of opposed, endless chain means 24 which, in turn, are driven in a timed relationship to grip tubing 30 and forcibly inject or withdraw the tubing into or out of well 11 depending on the direction in which the chains are driven. Injector units of this type are known and are commercially-available from various suppliers (e.g. Hydra-Rig, Fort Worth, Tx.).

Coiled tubing string 21 carries an expandable or inflatable packer 25 thereon, for a purpose explained below, and when its normal position will be in its retracted or deflated position as shown in FIG. 1. When in its retracted position, the outer diameter of packer 25 will be less than the diameter of production tubing 14 whereby coiled tubing 21 with packer 25 thereon can easily pass through the production tubing 21. Coiled tubing 21 has a plurality of openings 26 through the wall thereof which lie adjacent packer 25 for a purpose set forth below. A shoulder or seat 29 is affixed within coiled tubing 21 and is positioned slightly below the lower end of packer 25 for a purpose which will be described below.

Also carried on the lower end of coiled tubing string 21 are an artificial lift device 27, gas lift port, or the like and a pressure sensing device or means 28. Lift device aids in lifting fluids which may be standing in the wellbore when the coiled tubing 21 is run into place as will be explained in more detail below. It will be understood that this non-flowing condition within a well will almost always exist where formation pressure has been significantly depleted (e.g. to less that 0.45 psi/ft). Typically, in such situations, an inert gas such as nitrogen is injected from the bottom of the coiled tubing to lighten the liquid column and cause the formation fluids to spontaneously flow into the wellbore or a known lifting device (e.g. jet pump, etc. not shown) is used to produce the fluids to the surface to accomplish sufficient stable flow before the present pressure build-up test is carried out.

In carrying out the build-up test of the present invention, coiled tubing 21 with packer 25, lift device 27, and pressure sensing device 28 is lowered down production tubing 21 to a point substantially adjacent formation 11 (FIG. 1). If the pressure within formation 11 is insufficient to produce the formation fluids to the surface through production tubing 14, there will normally be a head of fluids present in the wellbore which counterbalances the formation pressures thereby resisting the further flow of fluids into the wellbore. Lifting device 27 is then actuated to unload the well by lifting these fluids and reestablishing flow from formation 11 into the wellbore.

Lift device 27 may consist merely of a sub having openings 29 therein or may consist of a jet pump or like device. A "power fluid" (e.g. gas under pressure) is flowed down coiled tubing 21 and through openings 29 into the standing head of fluids within wellbore to thereby decrease the fluid gradient, thus decreasing the bottom hole pressure thereby causing the fluids to flow upward to the surface through the annulus 30 which is formed between the coiled tubing 21 and the production tubing 14. As will be understood by those skilled in the art, where lift device 27 is a jet pump (e.g. "Powerlift Jet Pump", Halliburton, Dallas, Tex.) the power fluid exits through a nozzle (not shown) to mix with and boost the pressure of the production fluids to force the mixture out of openings 30 and back to the surface through annulus 31.

Figure 2:
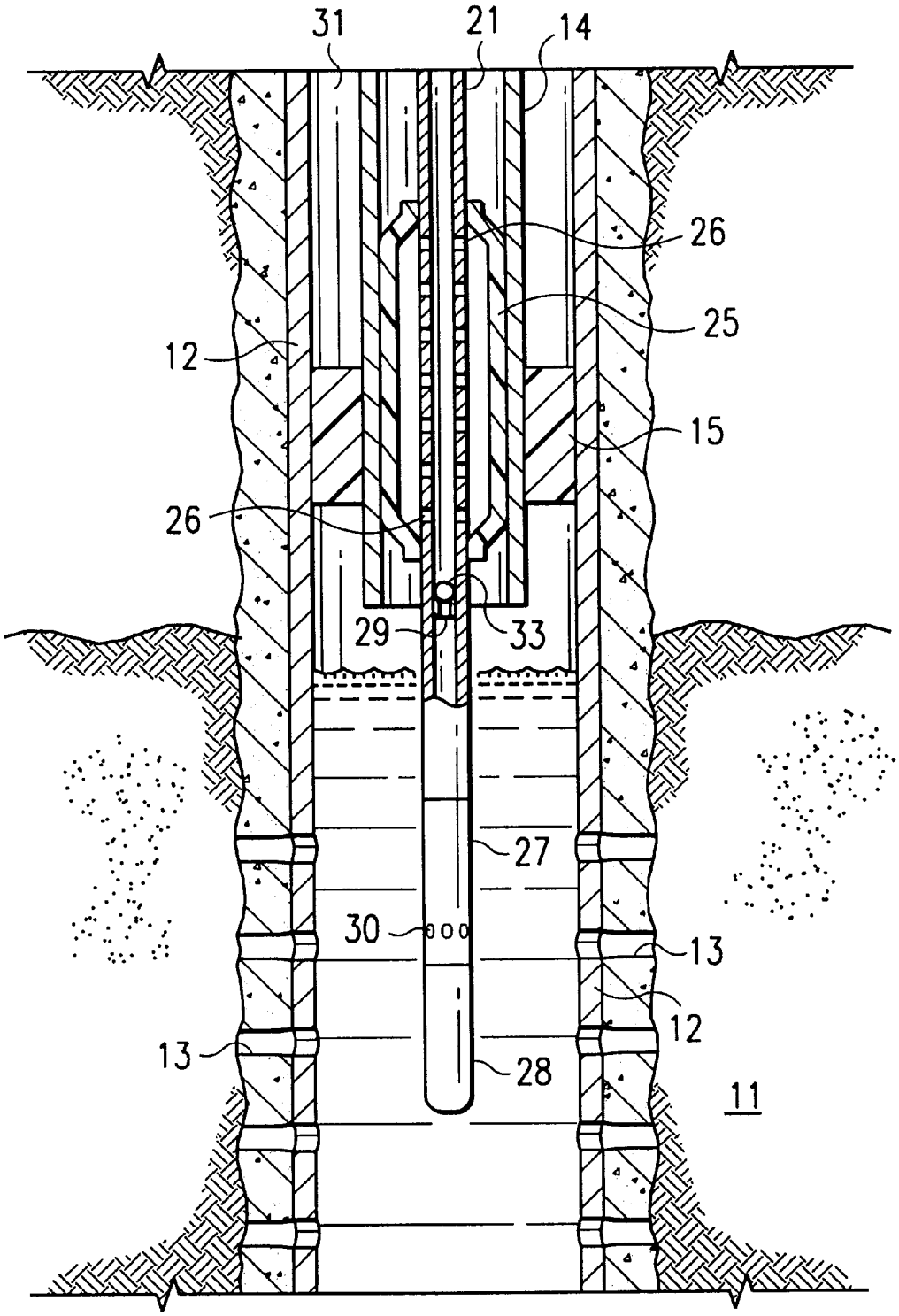
FIG. 2 is an enlarged view, partly in section, of the lower end of the apparatus of FIG. 1 with the packer thereof in an inflated position within the production tubing of the well.
Figure 3:
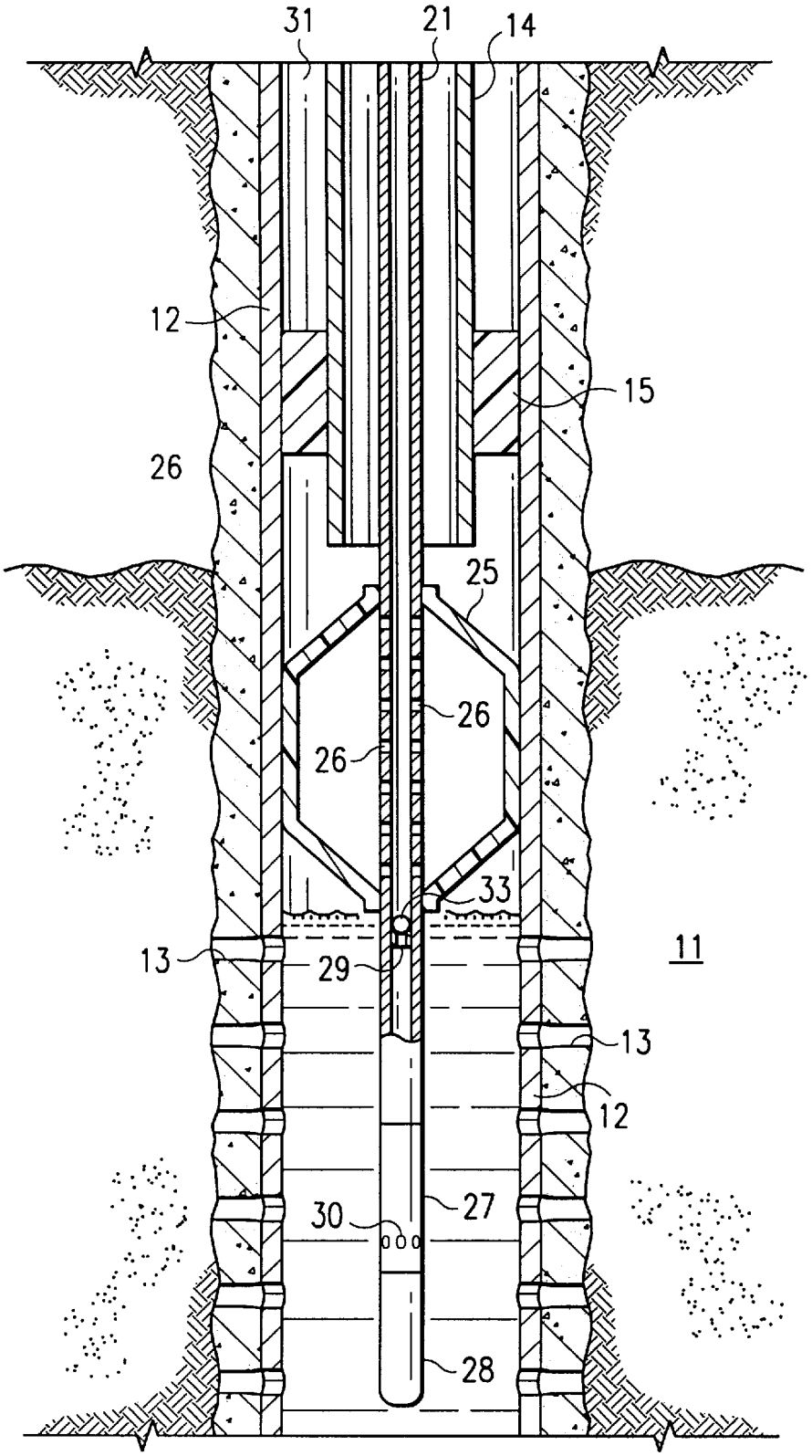
FIG. 3 is an enlarged view, partly in section of the lower end of the apparatus of FIG. 1 with the packer thereof in an inflated position below the lower end of the production tubing.

Once the head of standing fluids has been unloaded and flow from the formation 11 has been reestablished into the wellbore, a ball 33 is pumped down coiled tubing string until it seats and is sealingly engaged with seat 29. Continued pumping of fluid down coiled tubing 21 will now cause the fluid to flow through openings 26 and in behind packer 25 to inflate or expand packer 25 after which the pressure is maintained in the coiled tubing to keep the ball on the seat and the packer inflated. The packer 25 is sized so that it can expand and seal within production tubing 21 (FIG. 2) or :;an expand and seal with casing 12 (FIG. 3) or open hole (not shown) depending on the desired placement of the coiled-tubing string within wellbore 10. By maintaining the pressure in coiled tubing 21 on top of ball 33, formation 11 is now effectively isolated from the rest of the wellbore 10 above the packer 25.

In some instances, the formation may be damaged to the extent that the formation fluids may still be unable to readily flow into the wellbore. In those instances, a treating fluid (e.g. acid, solvent, bleach, etc.) can be flowed down the coiled tubing 21 to stimulated flow before carrying out the pressure test.

The fluids will now flow from formation 11 into the wellbore beneath packer 25 and the pressure will build-up therein during which time this pressure is measured by pressure sensing device 28. Device 28 may be any type of pressure sensing device which is capable of operating with a string of coiled tubing, e.g. DSP™, Downhole Sensor Package, Dowell-Schlumberger, Dallas, Tex. The pressure measurements can either be self-contained or preferably be relayed to the surface for real-time display and /or recording. The test will continue until sufficient data is collected to interpret reservoir properties from the character of the pressure data. In many cases, the improved quality of the data, due to shutting the well in downhole, will reduce the time required to gain the necessary pressure data.

Upon completion of the build-up test, the pressure within coiled tubing 21 above ball 33 is relaxed whereupon the pressure within the coiled tubing beneath the ball will cause the ball to unseat from seat 29. Now the resiliency of packer 25 will force the fluid therein back into the coiled tubing through openings 26 thereby allowing packer 25 to deflate. Alternately, if a different type of packer is used, upward and/or downward movement of the coiled tubing can be used to mechanically retract the packer, as will be understood in the art. Coiled tubing 21 then is free to be moved within the well to conduct another test, if desired, or be easily withdrawn to the surface after which well 10 can be returned to production.

What is claimed is:

1. In a wellbore having a string of production tubing therein which extends from the surface of the earth to a point substantially adjacent a subterranean producing formation, a method for carrying out a build-up pressure test of said formation, said method comprising:

lowering a string of coiled tubing through said production tubing to a point substantially adjacent said formation;

unloading said wellbore by forcing fluids standing within said wellbore to the surface and reestablishing flow from said formation into said wellbore prior to isolating said formation by actuating a jet pump which is carried by said string of coiled tubing and which is positioned substantially adjacent said formation to force said fluids in said wellbore towards said surface;

isolating said formation from said wellbore above said formation by setting a packer which is carried on said coiled tubing string; and sensing the pressure within said wellbore adjacent said formation.

2. The method of claim 1 including:

treating said formation before sensing the pressure within the wellbore by flowing a treating fluid through said coiled tubing.

3. The method of claim 1 wherein the step of setting said packer comprises:

sealing said coiled tubing below said packer by pumping a ball down said flow path through said coiled tubing and into sealing contact with a seat within said coiled tubing; and pumping fluid under pressure through said flow path through said coiled tubing above said packer and through openings in said coiled tubing adjacent said packer to thereby inflate said packer.

* * * * *